US010907467B2

(12) United States Patent
Gill et al.

(10) Patent No.: US 10,907,467 B2
(45) Date of Patent: Feb. 2, 2021

(54) SENSOR DEPLOYMENT USING A MOVABLE ARM SYSTEM AND METHOD

(71) Applicant: Sondex Wireline Limited, Farnborough (GB)

(72) Inventors: Timothy Michael Gill, Farnborough (GB); James David Ratcliffe, Farnborough (GB); Neil Geoffrey Harris, Farnborough (GB); Ian Hitchcock, Farnborough (GB)

(73) Assignee: Sondex Wireline Limited, Farnborough (GB)

( * ) Notice: Subject to any disclaimer, the term of this patent is extended or adjusted under 35 U.S.C. 154(b) by 76 days.

(21) Appl. No.: 16/013,320

(22) Filed: Jun. 20, 2018

(65) Prior Publication Data

US 2018/0363447 A1 Dec. 20, 2018

Related U.S. Application Data

(60) Provisional application No. 62/580,875, filed on Nov. 2, 2017, provisional application No. 62/522,367, filed on Jun. 20, 2017.

(51) Int. Cl.
*E21B 47/01* (2012.01)
*E21B 23/14* (2006.01)
(Continued)

(52) U.S. Cl.
CPC ..... *E21B 47/01* (2013.01); *E21B 17/026* (2013.01); *E21B 17/1021* (2013.01); *E21B 23/14* (2013.01)

(58) Field of Classification Search
CPC ..... E21B 47/01; E21B 17/026; E21B 23/14; E21B 17/1021; E21B 49/08
See application file for complete search history.

(56) References Cited

U.S. PATENT DOCUMENTS 3,186,420 A * 6/1965 Magee ..... E04H 15/48 135/88.07
4,184,546 A 1/1980 Nicolas et al.
(Continued)

FOREIGN PATENT DOCUMENTS

| | | |
|---|---|---|
| CN | 201090208 | 7/2008 |
| WO | 2016/137462 | 9/2016 |
| WO | 2016/159780 | 10/2016 |

OTHER PUBLICATIONS

"MaxTRAC Downhole Wireline Tractor System," 2018, Schlumberger Limited, https://www.slb.com/services/production/production_logging/conveyance/maxtrac_downhole_well_tractor.aspx.
(Continued)

*Primary Examiner* — Tara Schimpf
*Assistant Examiner* — Jonathan Malikasim
(74) *Attorney, Agent, or Firm* — Hogan Lovells US LLP

(57) ABSTRACT

A system for driving an arm radially outward from a work string axis includes a pivot block coupled to the arm at a first coupling, the arm rotating about the first coupling in a first direction to move from a stored position to an expanded position, and about the first coupling in a second direction to move from the expanded position to the stored position. The system also includes a biasing member that drives movement of the arm in the first direction. The system further includes a chamber for storing the biasing member within a pivot block diameter when the arm is in the stored position.

20 Claims, 7 Drawing Sheets

(51) Int. Cl.
*E21B 17/02* (2006.01)
*E21B 17/10* (2006.01)

(56) References Cited

U.S. PATENT DOCUMENTS

| | | | | |
|---|---|---|---|---|
| 4,673,890 | A | 6/1987 | Copland | |
| 4,715,440 | A | 12/1987 | Boxell et al. | |
| 4,926,937 | A | 5/1990 | Hademenos | |
| 5,086,645 | A | 2/1992 | Deaton | |
| 5,092,056 | A | 3/1992 | Deaton | |
| 5,548,900 | A | 8/1996 | Hunt-Grubbe | |
| 5,574,263 | A | 11/1996 | Roesner | |
| 6,176,129 | B1 | 1/2001 | Aguesse | |
| 6,454,030 | B1 | 9/2002 | Findley | |
| 6,560,889 | B1 * | 5/2003 | Lechen | E21B 47/08 33/542.1 |
| 6,629,568 | B2 | 10/2003 | Post et al. | |
| 6,910,533 | B2 | 6/2005 | Guerrero | |
| 6,920,936 | B2 | 7/2005 | Sheiretov et al. | |
| 7,114,386 | B1 | 10/2006 | Veignat et al. | |
| 7,281,578 | B2 | 10/2007 | Nakajima et al. | |
| 7,293,746 | B2 | 11/2007 | Brundage | |
| 7,334,642 | B2 | 2/2008 | Doering et al. | |
| 7,543,512 | B2 | 6/2009 | Smith | |
| 7,694,735 | B2 | 4/2010 | Haheim et al. | |
| 7,954,563 | B2 | 6/2011 | Mock et al. | |
| 8,453,744 | B2 * | 6/2013 | Buss | E21B 47/10 166/316 |
| 8,579,037 | B2 | 11/2013 | Jacob | |
| 9,051,823 | B2 * | 6/2015 | Maute | E21B 47/10 |
| 9,097,100 | B2 | 8/2015 | Finke | |
| 9,181,796 | B2 * | 11/2015 | Malone | E21B 47/01 |
| 9,303,478 | B2 * | 4/2016 | Scruggs | E21B 47/12 |
| 9,915,144 | B2 | 3/2018 | Manzar | |
| 2005/0145415 | A1 | 7/2005 | Doering | |
| 2006/0230846 | A1 | 10/2006 | Smith | |
| 2009/0093692 | A1 | 4/2009 | Hansma | |
| 2011/0127046 | A1 | 6/2011 | Aguirre | |
| 2011/0138903 | A1 | 6/2011 | Large | |
| 2013/0068479 | A1 | 3/2013 | AlDossary | |
| 2014/0352422 | A1 | 12/2014 | Paulsson | |
| 2015/0211312 | A1 | 7/2015 | Krueger | |
| 2016/0130935 | A1 | 5/2016 | Manzar | |

OTHER PUBLICATIONS

"Multiple Array Production Suite," 2018, General Electric, https://www.geoilandgas.com/oilfield/wireline-technology/multiple-array-production-suite.

International Search Report and Written Opinion dated Sep. 27, 2018 in corresponding PCT Application No. PCT/US2018/38561.

International Search Report and Written Opinion dated Oct. 19, 2018 in corresponding PCT Application No. PCT/US2018/038592.

Office Action dated Nov. 4, 2019 in related U.S. Appl. No. 16/013,407.

Office Action dated Nov. 4, 2019 in related U.S. Appl. No. 16/013,391.

* cited by examiner

SENSOR DEPLOYMENT USING A MOVABLE ARM SYSTEM AND METHOD

CROSS REFERENCE TO RELATED APPLICATION

This application claims priority to and the benefit of: U.S. Provisional Application Ser. No. 62/522,367 filed Jun. 20, 2017, titled "SENSOR DEPLOYMENT MECHANISM SYSTEM AND METHOD," and U.S. Provisional Application Ser. No. 62/580,875 filed Nov. 2, 2017, titled "SENSOR ARM DEPLOYMENT MECHANISM SYSTEM AND METHOD," the full disclosures of which is hereby incorporated herein by reference in its entirety for all purposes.

BACKGROUND

1. Field of Invention

This disclosure relates in general to oil and gas tools, and in particular, to systems and methods for sensor arm deployment from downhole logging tools.

2. Description of the Prior Art

In oil and gas production, various measurements are conducted in wellbores to determine characteristics of a hydrocarbon producing formation. These measurements may be conducted by sensors that are carried into the wellbore on tubulars, for example, drilling pipe, completion tubing, logging tools, etc. In embodiments, the sensors may be arranged on arms or members that deploy radially outward from the tubulars. Multiple measurements may be performed along different locations in the wellbore and at different circumferential positions. Often, the number of measurements leads to the deployment of several downhole tools, thereby increasing an overall length of the string, which may be unwieldy or expensive.

SUMMARY

Applicant recognized the problems noted above herein and conceived and developed embodiments of systems and methods, according to the present disclosure, for sensor deployment systems.

In an embodiment, a system for deploying a sensor into a wellbore annulus includes a work string extending from a surface location into the wellbore annulus. The system also includes a pivot block arranged on the work string and coupled to an arm that transitions between a stored position and an expanded position, the expanded position being farther from a work string axis than the stored position. The pivot block includes a slot axially aligned with at least a portion of the arm, the arm being positioned at least partially within the slot when the arm is in the stored position. The pivot block also includes a biasing member positioned at least partially within the slot and coupled to the pivot block and the arm, the biasing member driving the arm between the stored position and the expanded position. The pivot block further includes a channel formed in the pivot block and circumferentially offset from the slot.

In another embodiment, a system for moving a sensor into a flow path of a wellbore annulus includes a movable arm arranged on a work string extending into the wellbore annulus, the arm being movable between a first position having a first diameter and a second position having a second diameter, the second diameter being larger than the first diameter, wherein the sensor is mounted to at least a portion of the arm. The system also includes a pivot block arranged on the work string, the arm being rotatably coupled to the pivot block. The pivot block includes a biasing member coupled to the arm at a first position and the pivot block at a second position, the biasing member driving rotational movement of the arm about an axis to transition the arm between the first position and the second position. The pivot block also includes a chamber formed at least partially within a pivot block body and at least partially within the arm, the chamber receiving the biasing member when the arm is in the first position.

In an embodiment, a system for driving an arm radially outward from a work string axis including a pivot block coupled to the arm at a first coupling, the arm rotating about the first coupling in a first direction to move from a stored position to an expanded position, and about the first coupling in a second direction to move from the expanded position to the stored position. The system also includes a biasing member comprising a first extension and a second extension, the first extension being coupled to the arm and the second extension being coupled to the pivot block, wherein the biasing member drives movement of the arm in the first direction. The system further includes a chamber for storing the biasing member within a pivot block diameter when the arm is in the stored position.

BRIEF DESCRIPTION OF THE DRAWINGS

The present technology will be better understood on reading the following detailed description of non-limiting embodiments thereof, and on examining the accompanying drawings, in which.

DETAILED DESCRIPTION OF THE INVENTION

Figure 1:
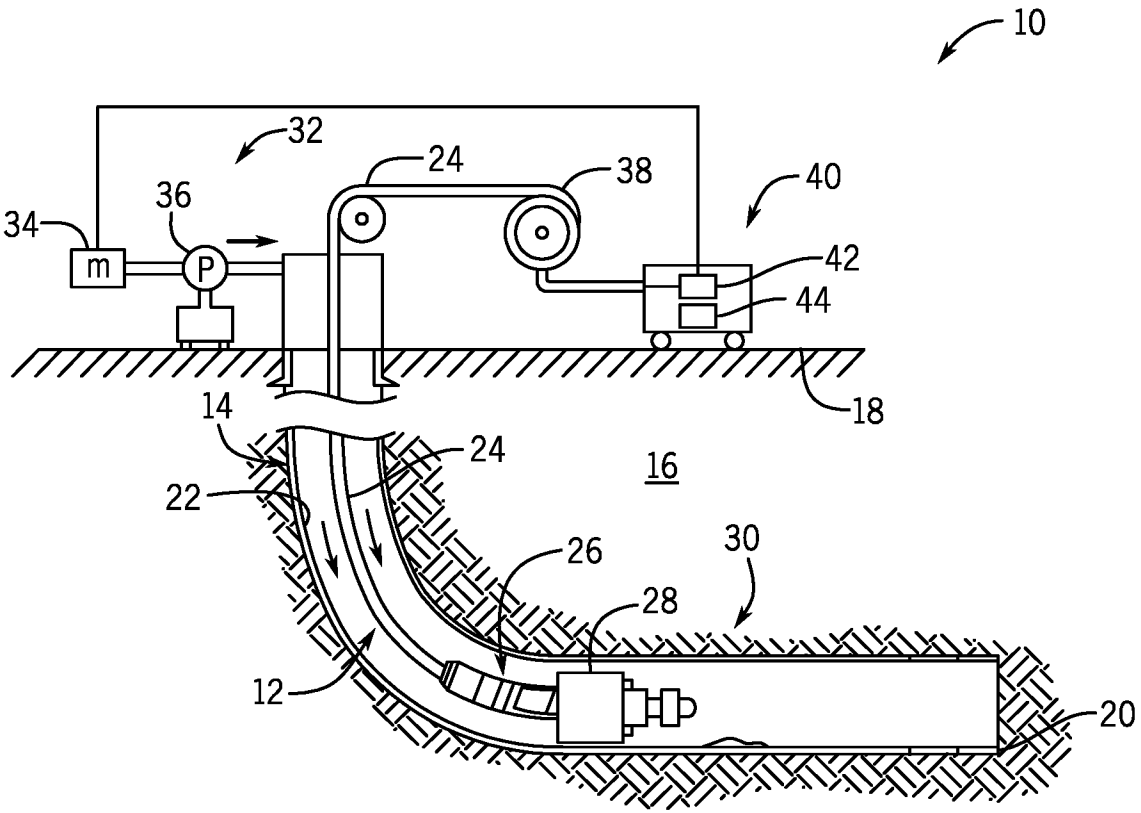
FIG. 1 is a schematic elevation view of an embodiment of a wellbore system, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present invention are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Embodiments of the present disclosure include systems and methods to perform downhole measurements in oil and gas formations. In certain embodiments, a downhole tool includes a plurality of extendable arms to arrange one or more sensors in a wellbore annulus to measure one or more characteristics of fluid (e.g., gas, liquid, solid, or a combination thereof) flowing through the annulus. The illustrated downhole tool includes a pair of stationary bulks heads, a pair of stationary pivot blocks, and arms extending between the pair of pivot blocks. In certain embodiments, one or more biasing members, such as a leaf spring, drive the extendable arms outwardly away from an axis of a tool string. In various embodiments, the arms are individually driven outwardly from the tool string axis, thereby enabling the arms to follow the contours of uneven wellbores. As will be described below, the arms may be mounted to a pivot block that includes one or more pockets or chambers for components of the arms. Moreover, the pivot block may include passages or channels to route cables from the one or more sensors arranged on the arms. In various embodiments, the downhole tool has an outer diameter that is substantially constant along a length. That is, the addition of the arms does not increase the outer diameter of the downhole tool when the arms are in a stored position, thereby enabling insertion into smaller wellbores. As will be described below, the various pockets or chambers of the pivot block enable compact storage of the arms proximate the tool string axis.

FIG. 1 is a schematic elevation view of an embodiment of a wellbore system 10 that includes a work string 12 shown conveyed in a wellbore 14 formed in a formation 16 from a surface location 18 to a depth 20. The wellbore 14 is shown lined with a casing 22, however it should be appreciated that in other embodiments the wellbore 14 may not be cased. In various embodiments, the work string 12 includes a conveying member 24, such as an electric wireline, and a downhole tool or assembly 26 (also referred to as the bottomhole assembly or "BHA") attached to the bottom end of the wireline. The illustrated downhole assembly 26 includes various tools, sensors, measurement devices, communication devices, and the like, which will not all be described for clarity. In various embodiments, the downhole assembly 26 includes a downhole tool 28 having extendable arms, which will be described below, for positioning one or more sensors into the annulus of the wellbore 14. In the illustrated embodiment, the downhole tool 28 is arranged in a horizontal or deviated portion 30 of the wellbore 14, however it should be appreciated that the downhole tool 28 may also be deployed in substantially vertical segments of the wellbore 14.

The illustrated embodiment further includes a fluid pumping system 32 at the surface 18 that includes a motor 34 that drives a pump 36 to pump a fluid from a source into the wellbore 14 via a supply line or conduit. To control the rate of travel of the downhole assembly, tension on the wireline 14 is controlled at a winch 38 on the surface. Thus, the combination of the fluid flow rate and the tension on the wireline may contribute to the travel rate or rate of penetration of the downhole assembly 16 into the wellbore 14. The wireline 14 may be an armored cable that includes conductors for supplying electrical energy (power) to downhole devices and communication links for providing two-way communication between the downhole tool and surface devices. In aspects, a controller 40 at the surface is provided to control the operation of the pump 36 and the winch 38 to control the fluid flow rate into the wellbore and the tension on the wireline 12. In aspects, the controller 40 may be a computer-based system that may include a processor 42, such as a microprocessor, a storage device 44, such as a memory device, and programs and instructions, accessible to the processor for executing the instructions utilizing the data stored in the memory 44.

In various embodiments, the downhole tool 28 may include extendable arms that include one or more sensors attached thereto. The arms enable the sensors to be arranged within the annulus, which may be exposed to a flow of fluid that may include hydrocarbons and the like moving in an upstream direction toward the surface 18. In various embodiments, the arms enable a reduced diameter of the downhole tool 28 during installation and removal procedures while still enabling the sensors to be positioned within the annulus, which may provide improved measurements compared to arranging the sensors proximate the tool body. As will be described below, in various embodiments the sensors may be communicatively coupled to the controller 40, for example via communication through the wireline 24, mud pulse telemetry, wireless communications, wired drill pipe, and the like. Furthermore, it should be appreciated that while various embodiments include the downhole tool 28 incorporated into a wireline system, in other embodiments the downhole tool 28 may be associated with rigid drill pipe, coiled tubing, or any other downhole exploration and production method.

Figure 2:
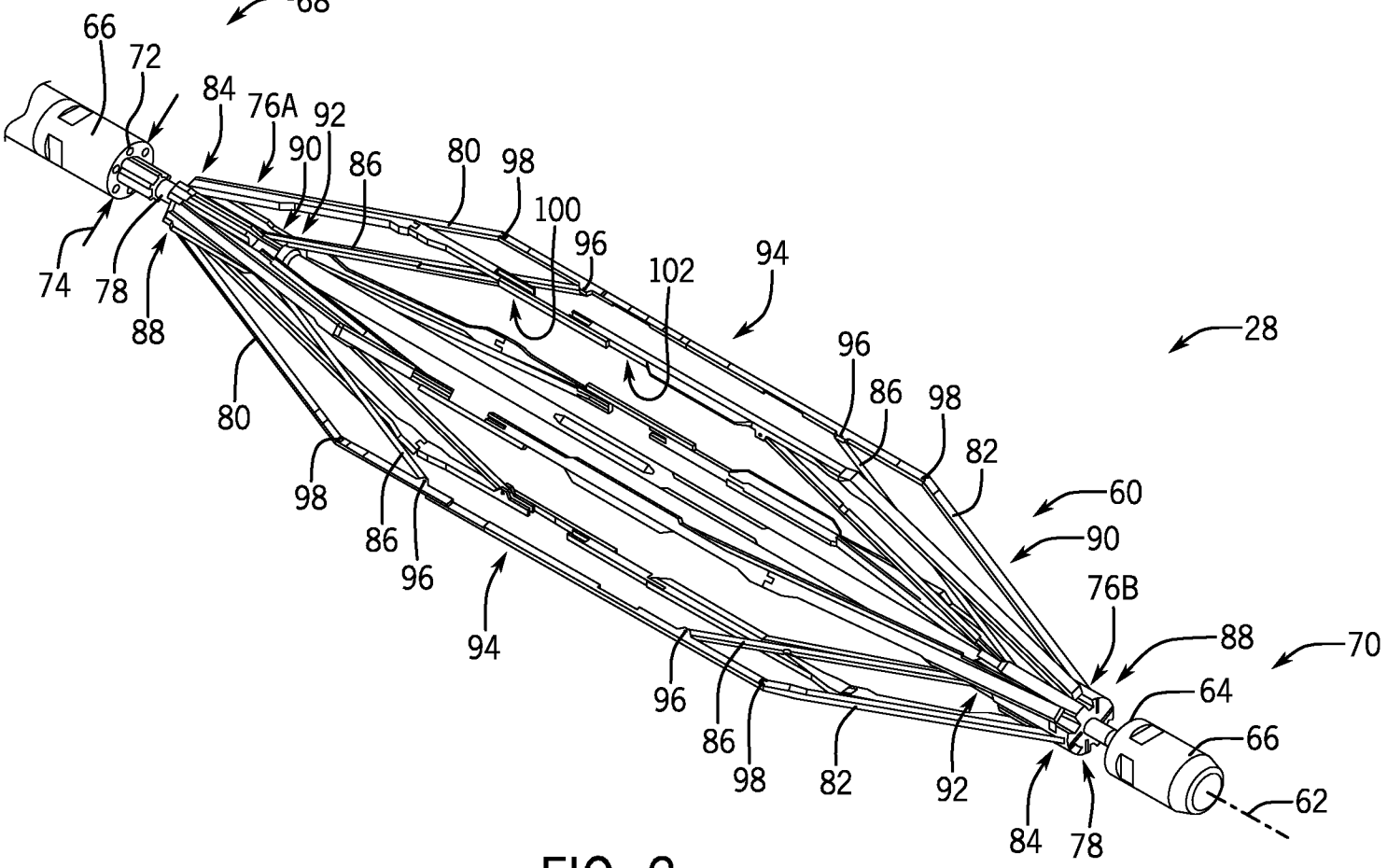
FIG. 2 is an isometric view of an embodiment of a downhole tool, in accordance with embodiments of the present disclosure.

FIG. 2 is an isometric perspective view of an embodiment of the downhole tool 28 including a plurality of extendable arms 60 (e.g., arms) arranged in an extended or deployed position. As illustrated in FIG. 2, the arms 60 are radially displaced from a tool string axis 62. The illustrated embodiment includes six arms 60, but it should be appreciated that in other embodiments more or fewer arms 60 may be included. For example, there may be one, two, three, four, five, ten, or any other reasonable number of arms 60 arranged on the downhole tool 28. In the illustrated embodiment, the arms 60 are arranged circumferentially about a circumference 64 of the tool 28 and are evenly spaced apart. However, in other embodiments, the arms 60 may not be evenly spaced apart. It should be appreciated that the spacing may be particularly selected based on anticipated downhole conditions. By arranging the arms 60 circumferentially about the downhole tool 28, the entire or substantially the entire annulus surrounding the downhole tool 28 may be analyzed using the arms 60 (e.g., using sensors coupled to the arms). Therefore, if flow at an upper portion were different than flow at a lower portion, for example, the different arms 60 would be arranged to monitor and report such flow characteristics to inform future wellbore activities. Furthermore, if fluid compositions were different along the annulus, the arrangement of the sensors circumferentially around the tool 28 may enable detection and measurement of the different fluid characteristics.

In various embodiments, a pair of bulkheads 66 are positioned at first and second ends 68, 70 of the downhole tool 28. For clarity with the discussion, the first end 68 may be referred to as the uphole side while the second end 70 may be referred to as the downhole side, however this terminology should not be construed as limiting as either end of the downhole tool 28 may be the uphole or downhole end and such arrangement may be determined by the orientation of the sensors coupled to the arms 60. Each of the illustrated bulkheads 66 include apertures 72 which may be utilized to route or otherwise direct cables coupled to the sensors arranged on the arms 60 into the tool body for information transmission to the surface 18, for example to the controller 40. It should be appreciated that each bulkhead 66 may include a predetermined number of apertures 72, which may be based at least in part on a diameter 74 of the downhole tool 28. Accordingly, embodiments of the present disclosure provide the advantage of enabling more sensors than traditional downhole expandable tools because of the presence of the pair of bulkheads 66. As will be described below, traditional tools may include a single bulkhead and a moving pivot block to facilitate expansion and contraction of arms for moving the sensors into the annulus. The end with the moving pivot block typically does not include a bulkhead due to the lateral movement of the pivot block along the tool string axis 62, which increases the likelihood that cables are damaged because of the increased movement.

In various embodiments, the one or more sensors may include flow sensors to measure speed of flow, composition sensors to determine the amount of gas or liquid in the flow, and/or resistivity sensors to determine the make of the flow (e.g., hydrocarbon or water). Additionally, these sensors are merely examples and additional sensors may be used. The bulkhead 66 may receive a sensor tube, cable, or wire coupled to the one or more sensors and includes electronics to analyze and/or transmit data received from the sensors to the surface. The illustrated bulkheads 66 are fixed. That is, the illustrated bulkheads 66 move axially with the downhole tool 28 and do not translate independently along the tool string axis 62. As a result, the cables coupled to the sensors may be subject to less movement and pulling, which may increase the lifespan of the cables.

FIG. 2 further illustrates a pair of pivot blocks 76 arranged on the downhole tool 28. In the illustrated embodiment, the pivot blocks 76 are positioned between the bulkheads 66. Further, each pivot block 76 of the pair of pivot blocks 76 is positioned proximate a respective bulkhead 66. That is, each of the pivot blocks 76 may be closer to one of the bulkheads 66. The pivot blocks 76 are coupled to the arms 60 at both ends to drive movement of the arms 60 between the illustrated expanded position, a stored position (not shown), and intermediate radial positions therebetween. The illustrated pivot blocks 76 include channels 78 to direct the sensor tube, cable, wire, or the like coupled to the one or more sensors toward the bulkhead 66, for example toward the aperture 72. It should be appreciated that, in various embodiments, there are an equal number of channels 78 and apertures 72. However, there may be more or fewer channels 78 and/or apertures 72. The illustrated pivot blocks 76 are fixed and do not move independently along the tool string axis 62. Rather, the pivot blocks 76 move with the tool string as the downhole tool 28 is inserted and removed from the wellbore 14. As described above, movement of the pivot blocks 76 in traditional systems may fatigue or position the cables such that damage may occur. However, providing a fixed position for the pivot blocks 76 protects the cables by reducing the amount of movement or flexion they may be exposed to.

The illustrated embodiment includes the arms 60 having a first segment 80 coupled to the pivot block 76A and a second segment 82 coupled to the pivot block 76B. The first and second segments 80 may be rotationally coupled to the respective pivot blocks 76 via a pin or journal coupling 84. However, pin and/or journal couplings are for illustrative purposes only and any reasonable coupling member to facilitate rotational movement of the first and second segments 80, 82 may be utilized. As will be described in detail below, rotational movement of the first and second segments 80, 82 move the arms 60 radially outward from the tool string axis 62. In various embodiments, a degree of relative motion of the first and second segments 80, 82 may be limited, for example by one or more restriction components, to block over-rotation of the first and second segments 80, 82. Furthermore, other components of the arms 60 may act to restrict the range of rotation of the first and second segments 80, 82.

The arms 60 further include a link arm 86, which is also coupled to the pivot block 76. As illustrated, the first and second segments 80, 82 are coupled to a respective far end 88 of the respective pivot block 76 while the link arm 86 is coupled to a respective near end 90 of the respective pivot block 76. The far end 88 is closer to the bulkhead head 66 than the near end 90. The link arm 86 is further coupled to the pivot block 76 via a pin or journal coupling 92, which may be a similar or different coupling than the coupling 84. The link arms 86 extend to couple to a telescoping section 94, for example via a pin or journal coupling 96. As illustrated, the first and second segments 80, 82 also coupling to the telescoping section 94, for example via a pin or journal coupling 98, at opposite ends.

It should be understood that, in various embodiments, the illustrated couplings between the first and second segments 80, 82, the link arms 86, the telescoping section 94, and/or the pivot block 76 may enable rotation about a respective axis. That is, the components may pivot or otherwise rotate relative to one another. In certain embodiments, the couplings may include pin connections to enable rotational movement. Furthermore, in certain embodiments, the components may include formed or machined components to couple the arms together while further enabling rotation, such as a rotary union or joint, sleeve coupling, or the like.

In the embodiment illustrated in FIG. 2 where the arms 60 are arranged in the expanded position, the combination of the first segment 80, the second segment 82, the link arms 86, and the telescoping section 94 generally form a parallelogram. As will be described in detail below, the telescoping section 94 includes a first section 100 and a second section 102 that are moveable relative to one another in response to rotation of the first and second segments 80 and/or link arms 86. In other words, the telescoping section 94 moves between an expanded position and a collapsed position based on the radial position of the arm 60 (e.g., one or more components of the arm 60).

In embodiments, properties of the arms 60, such as a length of the first segment 80, a length of the second segment 82, a length of the link arm 96, or a length of the telescoping section 94 may be particularly selected to control the radial position of the telescoping portion 94 with respect to the tool string axis 62. For example, the length of the first and second segments 80, 82 and the link arm 86 directly impact the radial position of the telescoping portion 94. In this manner, the position of the telescoping portion 94, and therefore the sensors coupled to the telescoping portion 94, may be designed prior to deploying the downhole tool 28. Furthermore, any number of sensors may be arranged on the arms. It should be appreciated that the sensors are not illustrated in FIG. 2 for clarity. In various embodiments, each arm 60 contains three sensors (e.g., flow, resistivity, composition), thereby performing a total of 18 different measurements with the illustrated downhole tool 28. The downhole tool 28 illustrated in FIG. 2 enables measurements at various locations in the annulus around the downhole tool 28, thereby providing information about flow characteristics at various circumferential positions in the annulus. As opposed to using multiple downhole tools over a vast length of a drill string, the illustrated downhole tool 28 measures and records flow conditions at a particular location in the wellbore 14 over substantially the entire annulus. In certain embodiments, the sensor tubes coupling the one or more sensors to the bulkheads 66 may be equally divided. In other embodiments, more or fewer sensor tubes may be coupled to one bulkhead 66.

FIGS. 3-7 include detailed views of embodiments of the pivot block 76 coupled to the arms 60, for example to the first segment 80 and the link arm 86. It should be appreciated that similar coupling arrangements may be utilized for the second segment 82 and the link arm 86 on the opposite end of the arm 60 coupled to the opposing pivot block 76. In various embodiments, features of the pivot block 76 will be illustrated that enable one or more biasing members, such as a leaf spring, to drive outward radial movement of the arms 60 relative to the tool string axis 62. Such outward radial movement will move the one or more sensors into the annulus of the wellbore 14 to enable a variety of measurements. Furthermore, various embodiments may include slots, channels, passages, or other features to enable compact storage of the arms 60. Such storage will reduce an outer diameter of the downhole tool 28 at the arms 60, thereby enabling installation into smaller wellhead assemblies.

Figure 3:
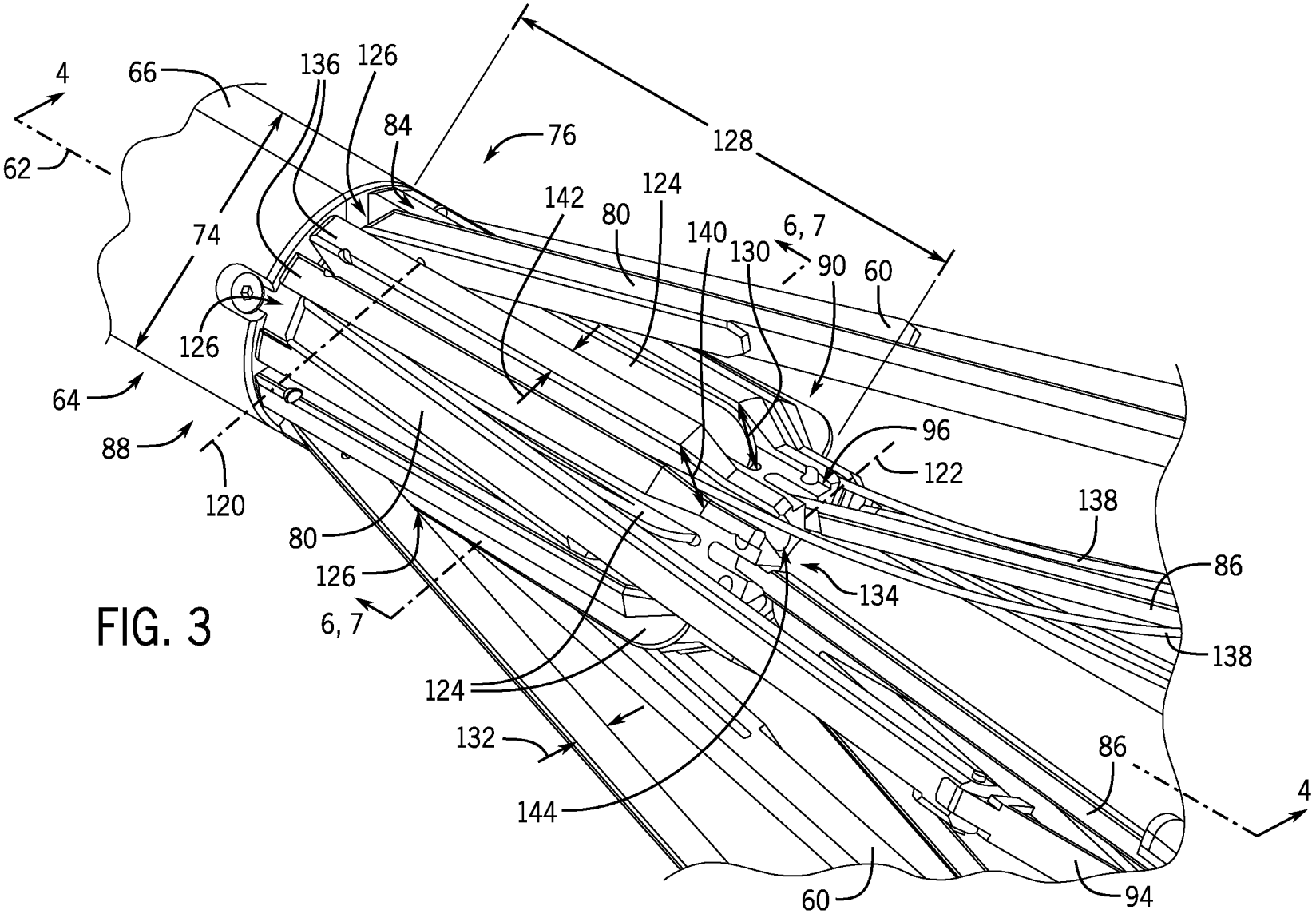
FIG. 3 is an isometric view of an embodiment of a pivot block, in accordance with embodiments of the present disclosure

FIG. 3 is a detailed isometric view of an embodiment of the pivot block 76 having a plurality of arms 60 coupled thereto. While the illustrated embodiment includes the plurality of arms 60, a single arm 60 may be discussed herein for clarity. The first segment 80 is coupled to the pivot block 76 at the coupling 84, which may be referred to as a pivot point, and positioned at the far end 88 of the pivot block 76. Additionally, in the illustrated embodiment, the link arm 86 is coupled to the pivot block 76 at the coupling 96, which may be referred to as a pivot point, at the near end 90 of the pivot block 76. It should be appreciated that the far end 88 is closer to the bulkhead 66 and the near end 90 is closer to the telescoping section 94. In various embodiments, the first segment 80 rotates about a segment axis 120, which may be substantially perpendicular to the tool string axis 62 while the link arm 86 rotates about a link axis 122, which may also be substantially perpendicular to the tool string axis 62 and substantially parallel to the segment axis 120. In various embodiments, the couplings 84, 96 are substantially axially aligned along the tool string axis 62.

In various embodiments, rotational movement about the respective axes 120, 122 is driven by a biasing member 124, which is illustrated as a leaf spring in the illustrated embodiment. The biasing member 124 applies a force to drive the arms 60 radially outward, away from the tool string axis 62. In various embodiments, outward force, for example from the wellbore walls, is sufficient to overcome the force applied by the biasing member 124 to drive the arms 60 radially inward toward the tool string axis 62. As such, it should be appreciated that the biasing member 124 may be particularly selected and designed for anticipated wellbore conditions, for example an anticipated diameter or pressure.

The illustrated embodiment includes individual biasing members 124 for each arm 60. As such, the arms 60 may be individually deployable, which may be advantageous when the wellbore 14 is not symmetrical or substantially symmetrical. For example, the wellbore 14 may not have a constant diameter, and as a result, different arms 60 on the downhole tool 28 may be deployed farther into the annulus than other arms 60. Additionally, in various embodiments the diameter of the wellbore 14 may be measured via the arms 60, for example, by determining the radial position of the respective arms 60 at different positions around the circumference 64. It should be appreciated that while the illustrated embodiment includes a single biasing member 124 for driving the arms 60 that in other embodiments multiple biasing members 124 may be utilized at each end of the arms 60 to drive the arms 60 radially outward from the tool body. Furthermore, in embodiments, a single biasing member 124 may drive more than one arm 60.

In various embodiments, the pivot block 76 includes a plurality of slots 126 for receiving the arms 60 when the arms 60 are in the stored position. For example, the slots 126 may span substantially a length 128 of the pivot block 76 to form an area for receiving and isolating at least a portion of the arms 60. However, it should be appreciated that in various embodiments the slots 126 may not span the length 128. The illustrated slots 126 have a depth 130, which may substantially correspond to a height 132 of at least a portion of the arms 60, for example the first segment 80 and/or the second segment 82. As such, the first segment 80 and/or the second segment 82 may be substantially collapsed within the depth 130 of the slots 126 when in the stored position, thereby maintaining the tool diameter 74. That is, the presence of the arms 60 on the downhole tool 28 are arranged so as to not increase the tool diameter 74.

The embodiment illustrated in FIG. 3 includes an individual slot 126 for each arm 60. However, it should be appreciated that the slot 126 may receive more than one arm 60 in other embodiments. The illustrated slots 126 are arranged substantially equally spaced around the circumference 64 of the downhole tool 28. However, as described above, the slots 126 may be arranged to correspond to the arms 60, and therefore may not be equally spaced about the circumference 64. The illustrated arrangement provides substantially 360 degrees of coverage within the annulus, thereby enabling measurements along different portions of wellbore flow.

In various embodiments, the pivot block 76 also includes channels 134 that are offset from the slots 126 and formed within dividers 136. The dividers 136 may form at least a portion of the pivot block body and refer to solid or otherwise elevated portions of the pivot block 76. The channels 134 enable routing of sensor tubes 138, which may be tube, cables, wires, or the like for transmitting electrical impulses from the sensors (not pictured) to the bulkhead 66. The cables 138 may be braided or metallic pressure bearing tubes that include wires to facilitate data transmission. As shown, the cables 138 are flexible enough to bend and follow the curvature or movement of the arms 60. In various embodiments, the channels 134 include a depth 140, which may be substantially larger than a width of the sensor tubes 138, thereby enabling isolation of the sensor tubes 138 from other components, such as the arms 60. In the illustrated embodiment, the depth 140 of the channels 134 is greater than the depth 130 of the slots 126. However, it should be appreciated that, in other embodiments, the depth 140 may be less than the depth 130 or they may be substantially equal.

As described above, in various embodiments the dividers 136 separate the slots 126 from the channels 134. In the illustrated embodiment, the slots 126 and the channels 134 are arranged in an alternating fashion. That is, the arrangement includes the divider 136, the slot 126, the divider 136, the channel 134, and so forth. Advantageously, this provides a distance 142 between the sensor tubes 138 and the arms 60, thereby reducing the likelihood of the sensor tubes 138 being tangled or otherwise engaged with the arms 60, which may lead to damage to the sensor tubes 138. Furthermore, the channels 134 may simplify routing and pre-deployment operations for the downhole tool 28. For instance, by having dedicated channels 134 for the cables 138, workers preparing the downhole tool 28 for deployment may have an indication on how to route and/or arrange the cables 138.

In the illustrated embodiment, the channels 134 include a substantially curved bottom 144. As will be appreciated, the curved bottom 144 may reduce the likelihood of the sensor tubes 138 catching along a corner or sharp edge, which may damage the sensor tubes 138. While not illustrated in FIG. 3, in various embodiments the channels 134 may further include a cover or retention mechanism to block or restrict movement of the sensor tubes 138 out of the channel 134.

Figure 4:
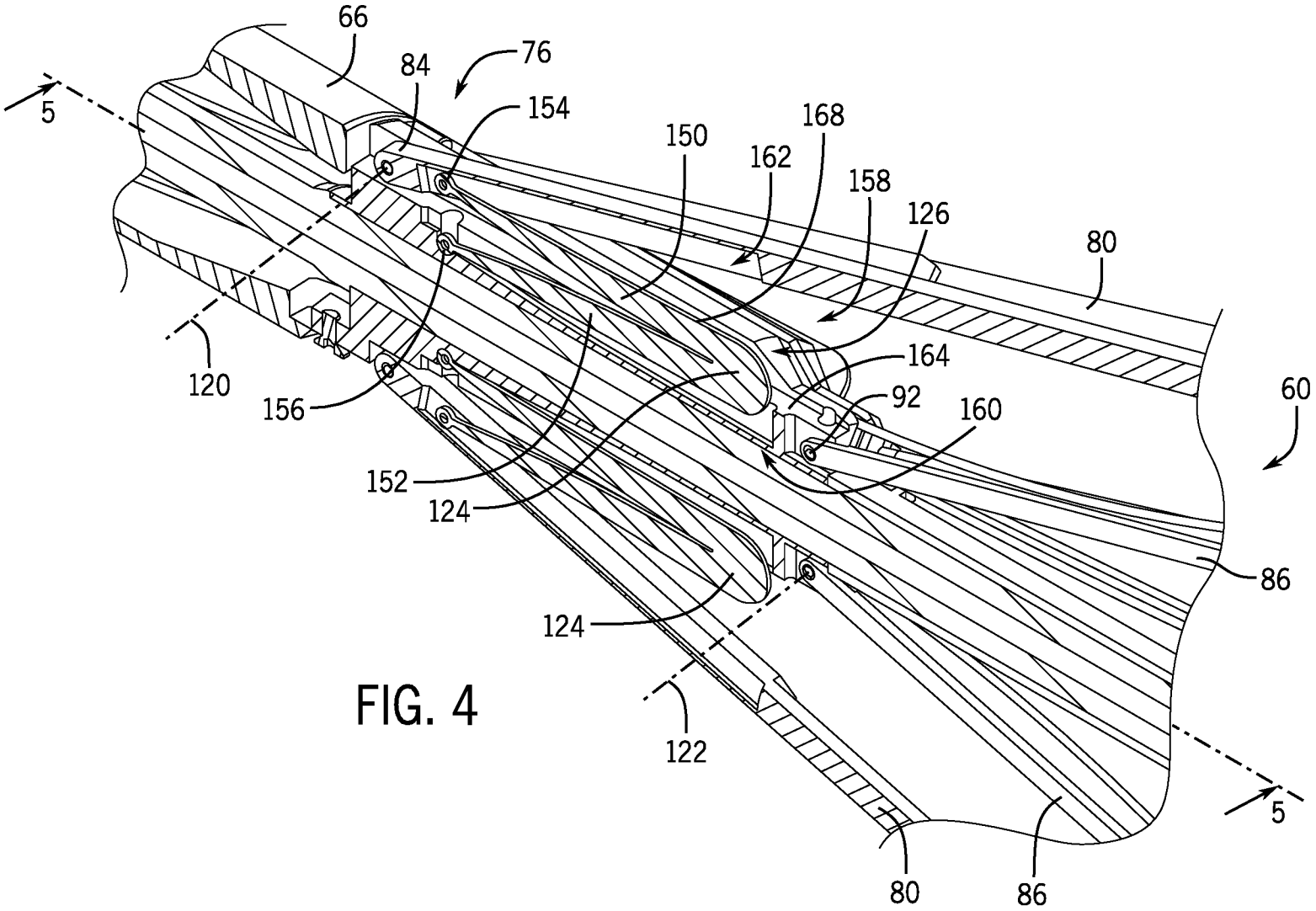
FIG. 4 is a cross-sectional isometric view of an embodiment of a pivot block taken along line 4-4, in accordance with embodiments of the present disclosure.

FIG. 4 is a cross-sectional isometric view of an embodiment of the pivot block 76, taken along line 4-4, illustrating a pair of arms 60 coupled thereto. As shown, the biasing member 124 illustrated in FIG. 4 has a wishbone shape that includes a first extension 150 and a second extension 152 coupling to the arm 60 and pivot block 76, respectively. While the illustrated embodiment includes a pin or pivoting connection, it should be appreciated that the first and second extensions 150, 152 may couple to components via hooks, slides, or any other reasonable method. In the illustrated embodiment, the first extension 150 couples to the first segment 80 at a coupling 154. The second extension 152 couples to the pivot block 76 at a coupling 156. It should be appreciated that in various embodiments the couplings 154, 156 may be rotatable couplings. Additionally, in embodiments, the couplings 154, 156 may be stationary or fixed couplings. It should be appreciated that, in various embodiments, the biasing member 124 may be either rotatably or fixedly coupled to one or more of the first segment 80 and the pivot block 76. That is, the respective extensions 150, 152 may be fixed to the arm 60, fixed to the pivot block 76, or fixed to both the arm 60 and the pivot block 76. In this manner, different coupling arrangements may be used to deploy the arms 60.

As described above, the force applied to the arm 60 by the biasing member 124 drives rotation about the coupling 84. That is, the first segment 80 rotates about the segment axis 120 due to the force from the biasing member 124 (or an external force to drive rotation in an opposite direction). Because the link arm 86 is coupled to at least one of the first segment 80 and/or the telescoping section 94, the link arm 86 also rotates about the respective coupling 92 (e.g., about the link axis 122) along with the first segment 80. Such rotation drives the telescoping section 94 radially outward from the tool string axis 62. As described above, the illustrated embodiment includes individual biasing members 124 for each arm 60. As a result, the arms 60 may be individually deployed. Individual deployment allows the arms 60 to follow the contours of the wellbore 14, as opposed to arms 60 that are deployed at the same time to the same radial position. Additionally, the downhole tool 24 is more compact because other deployment methods that may deploy all of the arms 60 together, such as a coil spring or hydraulically actuated system, are replaced by the smaller, lighter, and thinner biasing members 124. As described above, while the illustrated embodiment includes a single biasing member 124 coupled to the ends of each arm 60, in other embodiments multiple biasing members 124 may be coupled to each end of each arm 60, thereby enabling a greater force driving the arms 60 radially outward from the tool body.

In various embodiments, the biasing member 124 is thin such that the biasing member 124 may be stored within the body of the pivot block 76. For example, in the illustrated embodiment, the biasing member 124 is arranged within a chamber 158 formed by a combination of the pivot block 76 and the arm 60. That is, the chamber 158 is at least partially formed by a cutout 160 within the pivot block 76 and a recess 162 formed in the arm 60. That is, in combination, the cutout 160 and the recess 162 at least partially form the chamber 158. The chamber 158 further enables the compact and diameter-reducing downhole tool 28 of the present disclosure. By storing the biasing member 124 at least partially within the arm 60 being driven by the biasing member 124 itself, the diameter of the downhole tool 28 is not increased due to the presence of the on-boarding biasing member 124.

In the illustrated embodiment, the cutout 160 extends at least partially into the slot 126. That is, the cutout 160 may be formed within the slot 126, below (e.g., closer to the tool string axis 62) than a platform 164 for receiving the arm 60. As a result, the biasing member 124 is stored within the diameter 74 of the downhole tool 28. As illustrated, the biasing member 124 is thin, and as a result a width 166 (FIGS. 6 and 7) of the chamber 158 (e.g., of the cutout 160 and the recess 162) may be limited to be substantially equal to a width 168 of the biasing member 124 or a number of biasing members 124. In certain embodiments, the width 166 of the chamber 158 is smaller than a width 170 (FIGS. 6 and 7) of the slot 126. By arranging the biasing member 124 in the chamber 158, further space is saved, thereby enabling the pivot block 76 to have a reduced size and be utilized in smaller boreholes. Furthermore, the chamber 158 provides an indication during pre-deployment as to where the biasing member 124 should be installed.

As described above, the biasing members 124 in the illustrated embodiments are leaf springs having a substantially wishbone shape with a pair of extensions 150, 152 for coupling to the arm 60 and pivot block 76, respectively. It should be appreciated that the deployment force may be particularly selected for a variety of applications and may be based on the geometry of the biasing member 124. The geometry may be particularly selected to not exceed the yield stress of the material utilized for form the biasing members 124, such as spring steel, copper beryllium, or other alloys or metals that possess a high strain before yielding. Additionally, the design may be particularly selected such that a predetermined force is used to compress the springs. Additionally, the design may be particularly selected to deploy in certain situations, such as certain wellbore pressures and/or diameters.

Figure 5:
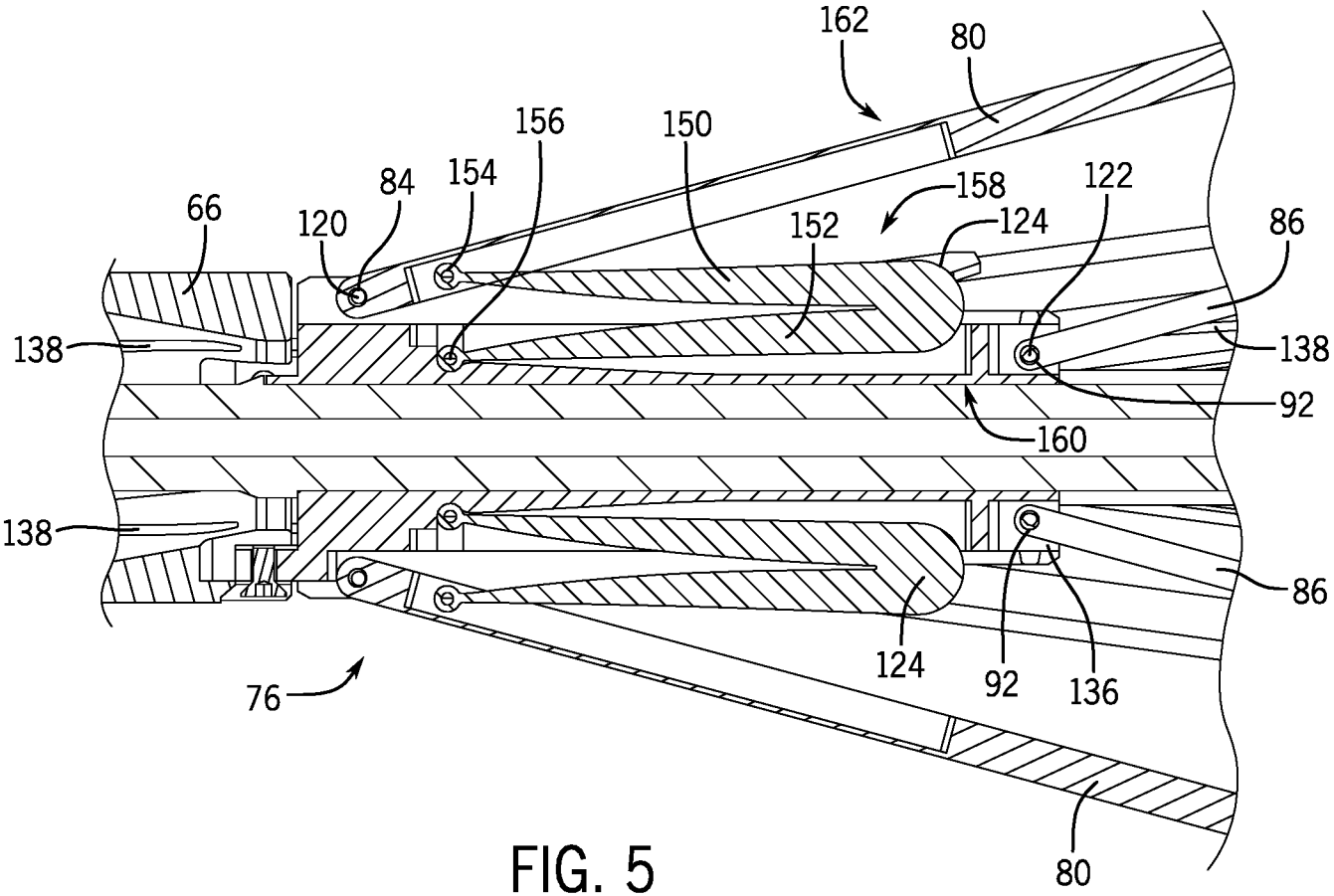
FIG. 5 is a cross-sectional side view of an embodiment of a pivot block taken along line 5-5, in accordance with embodiments of the present disclosure.

FIG. 5 is a cross-sectional side view of an embodiment of the pivot block 76, taken along line 5-5 including the biasing members 124 coupled to the pivot block 76 and the arms 60. In the illustrated embodiment, the extensions 150, 152 couple the arm 60 and the pivot block 76 to the biasing member 124, respectively. In various embodiments, the biasing member 124 is arranged with the chamber 158, for example such that at least a portion of the biasing member 124 is arranged within the cutout 160 in the illustrated embodiment. Force applied to the arms 60 via the biasing members 124 will drive rotation of the first segment 80 about the segment axis 120 to move the arms radially outward from the tool string axis 62.

The illustrated embodiment includes the sensor tube 138 extending through the pivot block 76 and into the bulkhead 66. As shown, the divider 136 separates the sensor tube 128 from the chamber 158, thereby reducing the likelihood that the arm 60 and or the biasing member 124 interact with and potentially damage the sensor tube 138.

Figure 6:
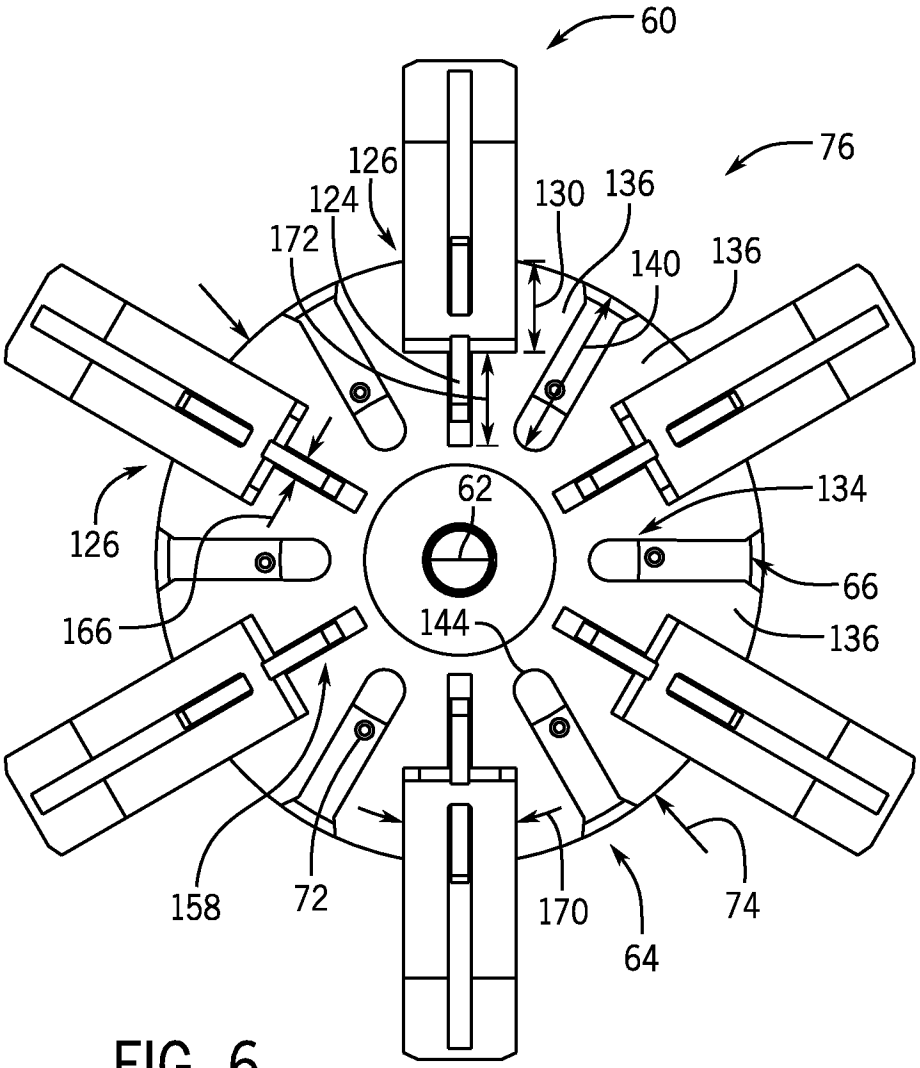
FIG. 6 is a cross-sectional end view of an embodiment of a pivot block taken along line 6,7-6,7, in accordance with embodiments of the present disclosure.

FIG. 6 is a cross-sectional end view of an embodiment of the pivot block 76, taken along line 6,7-6,7, including the plurality of arms 60 arranged circumferentially about the circumference 64 of the tool. The illustrated embodiment includes the bulkhead 66 visible through the channels 134. As described above, the bulkhead 66 may include the apertures 72, which may be substantially aligned with the channels 134 to facilitate routing and connection of the sensor tubes 138. While the arms 60 are illustrated spaced apart equally about the circumference 64, it should be appreciated that in other embodiments the arms 60 may not be equally spaced.

In the illustrated embodiment, the dividers 136 are arranged between the slots 126 and the channels 134. As a result, the sensor tubes 138 may be isolated or separated from the arms 60, at least at the pivot block 76, to thereby reducing the likelihood of tangling the sensors tubes 138 with the arms 60, which may lead to damage of the sensor tubes 138. The illustrated embodiment includes an equal number of channels 134 and slots 126. However, it should be appreciated that there may be more channels 134 than slots 126 or more slots 126 than channels. In various embodiments, the channels 134 may receive more than one sensor tube 138. For example, as described above, in certain embodiments each arm 60 may include three sensors, which would include a total of 18 sensors on the downhole tool 28. However, in the embodiment illustrated in FIG. 6, there would be a total of 12 channels 134. Accordingly, in various embodiments the number of channels 134 may be particularly selected to accommodate the anticipated number of sensor tubes 138 or more than one sensor tube 138 may be arranged within the channels 134.

As shown in FIG. 6, the illustrated arms 60 are arranged between the stored and expanded position, and as a result, the arms are not aligned with the diameter 74 of the tool 28. In the illustrated embodiment, the biasing members 124 are substantially centered within the slots 126 and drive movement of the arms 60 radially outward from the tools string axis 62. The chamber 158 is further illustrated extending into the pivot block 76 to receive at least a portion of the biasing member 124 within the diameter 74 to maintain the compact structure of the downhole tool 28. As described above, the chamber 158 is at least partially formed by the cutout 160, which extends into the tool string body for a cutout depth 172 that is closer to the tool string axis 62 than the slot depth 130. In other words, the cutout depth 172 is positioned deeper than the slot depth 130.

Figure 7:
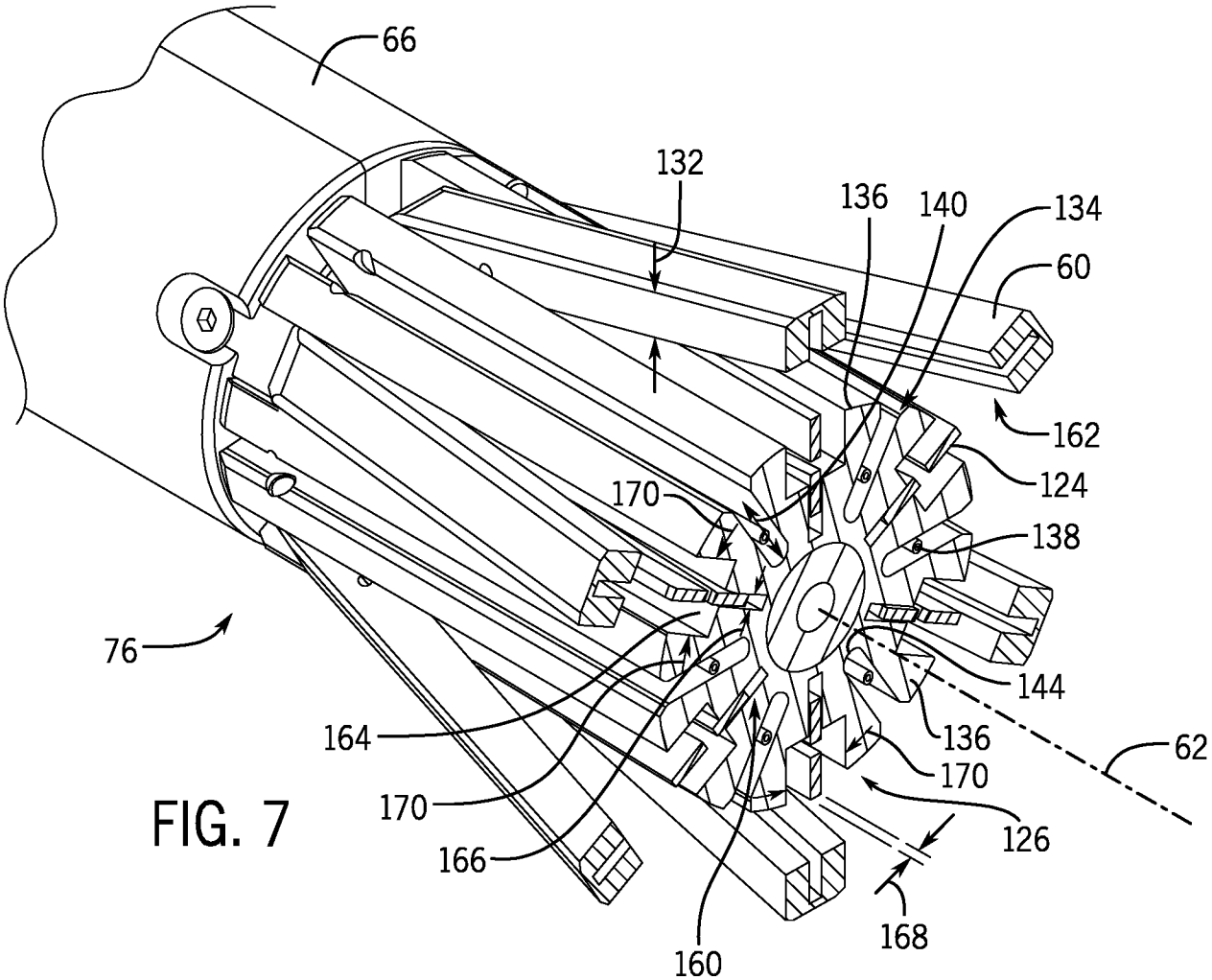
FIG. 7 is a sectional isometric view of an embodiment of a pivot block taken along line 6,7-6,7, in accordance with embodiments of the present disclosure.

FIG. 7 is a sectional isometric view of an embodiment of the pivot block 76, taken along line 6,7-6,7, includes the arms 60 extending outwardly from the tool string axis 62. The slots 126 extending radially into the pivot block 76 are illustrated as receiving at least a portion of the arms 60 and the biasing member 124 within the cutout 160. Furthermore, the recess 162 formed in the arm 60 is illustrated, which in combination with the cutout 160 forms the chamber 158 for storing the biasing member 124 in the stored position.

As described above, in various embodiments the dividers 136 extend between the slots 126 and the channels 134 to separate the arms 60 from the sensor tubes 138. Furthermore, the relative radial positions of the arms 60 and the sensor tubes 138 also provide separation to reduce the likelihood of interaction between the arms 60 and sensor tubes 138. For example, in the illustrated embodiment the platform 164 is farther radially outward from the tool string axis 62 than the curved bottom 144 of the channel 134. As a result, the sensor tubes 138 may also be closer to the tool string axis 62 and radially inward from the platform 164. It should be appreciated that in certain embodiments, the channels 134 may include one or more fasteners to hold or secure the sensor tubes 138 within the channels 134, which may also reduce the likelihood of interaction between the sensor tubes 138 and the arms 60.

Embodiments of the present disclosure include a downhole tool 28 with an array of deployment arms 60 which may be deployed radially outward from the tool body into a surrounding wellbore annulus. Each deployment arm 60 may be independently pivotable due to individual biasing members 124, such as leaf springs, applying forces to the arms 60. Accordingly, each arm 60 may individually follow a profile of the wellbore 14. Additionally, utilizing the smaller individual biasing members 124 produces a compact design that efficiently utilizes spaces within the pivot block 76. In various embodiments, one or more sensors may be coupled to the arms 60 to obtain wellbore measurements. These sensors may include one or more sensor tubes 138 that are directed back toward the bulkhead 66 for data processing. In embodiments, one or more channels 134 are arranged within the pivot block 76 to receive the cables, thereby reducing the likelihood of inadvertent damage as well as providing an indication on how to route the sensor tubes 138.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. A system for deploying a sensor into a wellbore annulus, the system comprising:

a work string extending from a surface location into the wellbore annulus; and a pivot block arranged on the work string and coupled to an arm that transitions between a stored position and an expanded position, the expanded position being farther from a work string axis than the stored position, the pivot block comprising:

a slot axially aligned with at least a portion of the arm, the arm being positioned at least partially within the slot when the arm is in the stored position;

a biasing member positioned at least partially within the slot and coupled to the pivot block and the arm, the biasing member driving the arm between the stored position and the expanded position; and a channel formed in the pivot block and circumferentially offset from the slot, the channel having a smaller width than the slot.

2. The system of claim 1, further comprising:

a divider positioned between the slot and the channel to separate the slot from the channel.

3. The system of claim 1, further comprising:

a recess formed in the arm, the recess receiving at least a portion of the biasing member; and a cutout formed in the pivot block and aligned with the recess, the cutout receiving at least a portion of the biasing member.

4. The system of claim 1, further comprising:

a plurality of slots arranged circumferentially about a circumference of the pivot block.

5. The system of claim 1, further comprising:

a plurality of channels arranged circumferentially about a circumference of the pivot block.

6. The system of claim 1, wherein a slot depth is substantially equal to an arm height, the arm height being substantially flush with the slot depth when the arm is in the stored position, such that a diameter of the pivot block is substantially unchanged by the arm in the stored position.

7. The system of claim 1, wherein a channel depth corresponding to a radial distance the channel extends toward the work string axis is greater than a slot depth corresponding to a radial distance the slot extends toward the work string axis.

8. The system of claim 1, further comprising:

a bulkhead arranged on the work string, the bulk head comprising an aperture that substantially aligns with the channel to receive a sensor tube extending from a sensor arranged on the arm.

9. The system of claim 1, wherein the biasing member is rotatably coupled to at least one of the arm or the pivot block.

10. A system for moving a sensor into a flow path of a wellbore annulus, the system comprising:

a movable arm arranged on a work string extending into the wellbore annulus, the movable arm being movable between a first position having a first diameter and a second position having a second diameter, the second diameter being larger than the first diameter, wherein the sensor is mounted to at least a portion of the movable arm;

a pivot block arranged on the work string, the movable arm being rotatably coupled to the pivot block, wherein the pivot block comprises:

a biasing member coupled to the movable arm at a first end and the pivot block at a second end, the biasing member driving rotational movement of the movable arm about an axis to transition the movable arm between the first position and the second position; and a chamber formed at least partially within a pivot block body and at least partially within the movable arm, the chamber receiving at least a portion of the biasing member when the movable arm is in the first position, the chamber extending between a first pivoting location of the moveable arm and a second pivoting location of a link arm coupled to the movable arm and to the pivot block, the chamber having a cutout depth formed in the pivot block body, the cutout depth being positioned deeper than a slot depth of a slot formed in the pivot block body to receive at least a portion of the movable arm.

11. The system of claim 10, wherein the chamber further comprises:

a recess formed in the movable arm, the recess having a first width; and a cutout formed in the pivot block, the cutout having a second width;

wherein a biasing member width is less than the first width and the second width.

12. The system of claim 10, wherein the slot depth is less than or equal to a height of the movable arm.

13. The system of claim 10, further comprising a platform, wherein a platform depth is less than the cutout depth, a cutout extending radially inward into the pivot block body and forming at least a portion of the chamber.

14. The system of claim 10, further comprising:

a channel extending radially into the pivot block body, the channel being circumferentially offset from the movable arm.

15. The system of claim 14, wherein the channel receives a sensor tube extending from the sensor, the channel directing the sensor tube away from the movable arm.

16. A system for driving an arm radially outward from a work string axis, the system comprising:

a pivot block coupled to the arm at a first coupling, the arm rotating about the first coupling in a first direction to move from a stored position to an expanded position, and about the first coupling in a second direction to move from the expanded position to the stored position;

a wishbone-shaped biasing member comprising a first extension and a second extension, the first extension being coupled to the arm and the second extension being coupled to the pivot block, wherein the biasing member drives movement of the arm in the first direction; and a chamber for storing the biasing member within a pivot block diameter when the arm is in the stored position, the chamber extending between a first pivoting location of the arm and a second pivoting location of a link arm coupled to the arm and to the pivot block, the chamber having a cutout depth formed in a pivot block body, the cutout depth being positioned deeper than a slot depth of a slot formed in the pivot block body to receive at least a portion of the movable arm.

17. The system of claim 16, wherein the chamber comprises:

a recess formed in the arm, the recess having a first width for receiving at least a portion of the biasing member;

a cutout formed in the pivot block, the cutout having a second width for receiving at least a portion of the biasing member.

18. The system of claim 17, wherein the first width is substantially equal to the second width and the recess and cutout are substantially aligned with a midpoint of the arm.

19. The system of claim 16, further comprising:

a channel formed in the pivot block and extending radially inward toward the work string axis; and the slot formed in the pivot block and extending radially inward toward the work string axis.

20. The system of claim 19, further comprising:

a plurality of channels arranged circumferentially about the pivot block; and a plurality of slots arranged circumferentially about the pivot block;

wherein the plurality of channels and the plurality of slots are offset from one another such that the plurality of channels and the plurality of slots do not overlap, and the plurality of channels are separated from the plurality of slots by a plurality of dividers.

* * * * *